US006189265B1

(12) United States Patent
Fink

(10) Patent No.: US 6,189,265 B1
(45) Date of Patent: Feb. 20, 2001

(54) ONE- OR TWO-LEAF SLIDING DOOR, SWINGING DOOR OR POCKET DOOR

(75) Inventor: Martin Fink, Waidhofen a.d. Ybbs (AT)

(73) Assignee: IFE Industrie-Einrichtungen Fertigungs-Aktiengesellschaft, Waidhofen a.d. Ybbs (AT)

( * ) Notice: Under 35 U.S.C. 154(b), the term of this patent shall be extended for 646 days.

(21) Appl. No.: 08/816,559

(22) Filed: Mar. 13, 1997

Related U.S. Application Data

(63) Continuation of application No. 08/448,442, filed on Jun. 5, 1995, now abandoned.

(30) Foreign Application Priority Data

Oct. 5, 1993 (AT) ..... 1998/93
Jan. 3, 1994 (AT) ..... 4/94

(51) Int. Cl.[7] ..... E05C 7/06
(52) U.S. Cl. ..... 49/118
(58) Field of Search ..... 49/324, 322, 116, 49/118; 192/99 R

(56) References Cited

U.S. PATENT DOCUMENTS 3,392,812 * 7/1968 Kaptur et al. ..... 192/99 R
4,060,310 * 11/1977 Brown ..... 49/324 X
5,077,938 * 1/1992 Moreuil ..... 49/141 X

FOREIGN PATENT DOCUMENTS 3602781 8/1986 (DE) .
2118667 11/1983 (GB) .

* cited by examiner

*Primary Examiner*—Jerry Redman
(74) *Attorney, Agent, or Firm*—Friedrich Kueffner

(57) ABSTRACT

A one-leaf or two-leaf sliding door, swinging/sliding door or pocket door, particularly for vehicles, has an electric, pneumatic or hydraulic drive. A nut is attached to the at least one door leaf and a spindle extends through the nut. A drive for moving the at least one door leaf is provided either to rotate the spindle directly or to linearly move the at least one door leaf. A freewheel is mounted on an end of the spindle, wherein the freewheel has a component which is stationary relative to but capable of rotating together with the spindle. A releasable brake or clutch is provided for preventing rotation of the freewheel component.

13 Claims, 8 Drawing Sheets

ONE- OR TWO-LEAF SLIDING DOOR, SWINGING DOOR OR POCKET DOOR

This is a continuation of application Ser. No. 08/448,442 filed Jun. 5, 1995 now abandoned.

BACKGROUND OF THE INVENTION

1. Field of the Invention

The invention is directed to one-leaf or two-leaf sliding doors, swinging doors or pocket doors with an electric, pneumatic or hydraulic drive, in particular for vehicles, wherein a spindle is provided, the leaf or leaves being connected therewith via a nut, wherein, in the case of two-leaf doors, the spindle is constructed symmetrically with respect to the center of the door, and wherein the door drive acts either rotatively on the spindle or linearly on one of the leaves.

2. Description of the Related Art

A swinging/sliding door with an electric drive is known, for example, from DE-C 36 30 229 which discloses a two-leaf door in which each leaf has an upper and a lower guide rail in which at least one roller engages in each instance. The vertically extending rotational axis of the rollers is swivelable about a vertically extending door post pipe, this swiveling movement causing the door to open outward.

Since the electric drive can carry current only when the door is actuated, a dead-center mechanism is required for locking the door so as to ensure that the closed door cannot be opened by manipulation.

As another consequence of this dead-center mechanism, the door is only locked when it has been moved completely into the final closing position, so that any failure of the drive or any obstacle preventing the door from being closed completely will allow the door to open, e.g., as a result of the vibrations of the moving vehicle. On the other hand, the dead-center mechanism must also be adjusted precisely which, under heavy-duty operating conditions and during large differences in temperature, is difficult and accordingly disadvantageous.

The use of the door post pipe which is associated with each door leaf and is located at the edge of the door opening in the region of the lateral closing edge is another great disadvantage. When the door is open, this door post pipe can be covered only with difficulty and, even then, not completely. In the process of closing the door, the door post pipe in the region of the lateral closing edge poses the most serious kind of risk, especially for children and older, frail persons seeking a handhold.

Problems also occur in alignment because the door post pipe must be fitted and aligned in the floor region as well as in the roof region. There is no need to demonstrate in particular such problems which occur in all three axial directions.

Swinging/sliding doors with a pneumatic or hydraulic drive in which the door leaves are guided in a swivelable manner by means of a slide so as to be longitudinally displaceable at a stationary circular supporting pipe have also been known from Austrian Patent document 188 323. The corresponding guide rails for the opening out movement and for longitudinal guidance are arranged on the vehicle side in the region of the upper edge and lower edge of the door. Suitable guide rollers are provided at the door leaf The drive is effected via a cylinder-piston unit, and various lever mechanisms and scissor mechanisms have been suggested for reducing installation width. In the closed state, these doors are locked in the region of the lateral closing edge by a mechanism arranged in that location so that they remain closed while the vehicle is in motion in the event of a drop in pressure in the drive, but also because the normal operating pressure is not sufficient to prevent the door from opening in a reliable manner. It is not possible to achieve an operating pressure sufficient for this purpose in an economical manner due to the required wall thickness of the pipes and tubes.

The lock projecting beyond the free profile of the door at the height of the door handle in the region of the lateral closing edge poses a source of risk on a par with the door post pipe in the construction mentioned above.

SUMMARY OF THE INVENTION

The object of the present invention is to provide a one-leaf or two-leaf door of one of the types mentioned above which does not have their disadvantages and which is easy and simple to install and remove and in which, in particular, alignment is also simplified. Moreover, the lateral closing edge should be unencumbered by obstacles and objects or built-in elements posing a risk of pinching.

These objectives are met according to the invention in that the spindle is provided at one end with a freewheel and a releasable brake or clutch preventing the rotation of the stationary part of the freewheel.

As a result of this construction, a self-adjusting, continuous locking of doors is achieved which dispenses with the dead-center mechanism, the locking at the lateral closing edge, and the undesirable door post.

The actual hanging of the door can be effected in different ways corresponding to the prior art and depends on whether the door has one or two leaves, on whether it is a sliding door, swinging/sliding door or a pocket door as well as on the type of drive provided.

The release of the brake or clutch during the opening movement is preferably effected electrically also when a pneumatic or hydraulic drive is used, since this allows a simpler control and a smoother opening than pneumatic or hydraulic actuation.

In two-leaf doors, not only is the door movement synchronized by the spindle drive, but the transmission of movement forces for a door leaf is also effected via the spindle when the actual door drive acts on a door leaf That is, the movement of this door leaf in this case sets the spindle in rotation via the nut connected with the door leaf, this rotation being transmitted to the other door leaf via its nut in such a way that both leaves open and close synchronously since, as was mentioned above, the spindle is constructed symmetrically with respect to the center of the door so as to be right-handed along half its length and left-handed along the other half.

Of course, a linear drive can also act on an independent nut arranged on the spindle so that both door leaves are moved by means of the spindle. This is also the case in a drive producing a rotational movement in the spindle, e.g., an electric motor which sets the spindle in rotation via a toothed belt or a toothed wheel gear unit.

Another advantage which can be achieved with the invention consists in the advantageous arrangement of a pneumatic piston-cylinder unit above the door. The length of the piston corresponds to roughly half the width of the door, that is, it corresponds to a door leaf. Since it acts on the door leaf to which it is adjacent, it can act directly on this leaf or on a projection arranged at this leaf without a rod linkage or scissor mechanism. The door leaf located below the pneumatic piston-cylinder unit is moved via the spindle without taking up substantial space.

In a development of the invention, a door support in the form of a roller arranged at the door frame is provided in the region of the lateral closing edge of the door above the conventional height of a handle and preferably near the upper edge of the door so that it is covered by the covering of the door drive. The axis of this roller extends substantially horizontally and lies normal to the movement direction of the door in the final closing region and cooperates with a supporting surface of the door which comes to rest under the roller.

Surprisingly, this brings about a substantial improvement in the stability of the door in the closed state, since any attempt to open the door, whether on the part of passengers or as a result of pressure shocks caused by wind resistance, results in a lifting of the door in the region of the lateral closing edge. The support effectively counters this lifting and accordingly prevents the door from being lifted out and opened.

Other advantages and details are explained more fully in the description of the drawings.

DESCRIPTION OF THE PREFERRED EMBODIMENTS

Figure 1:
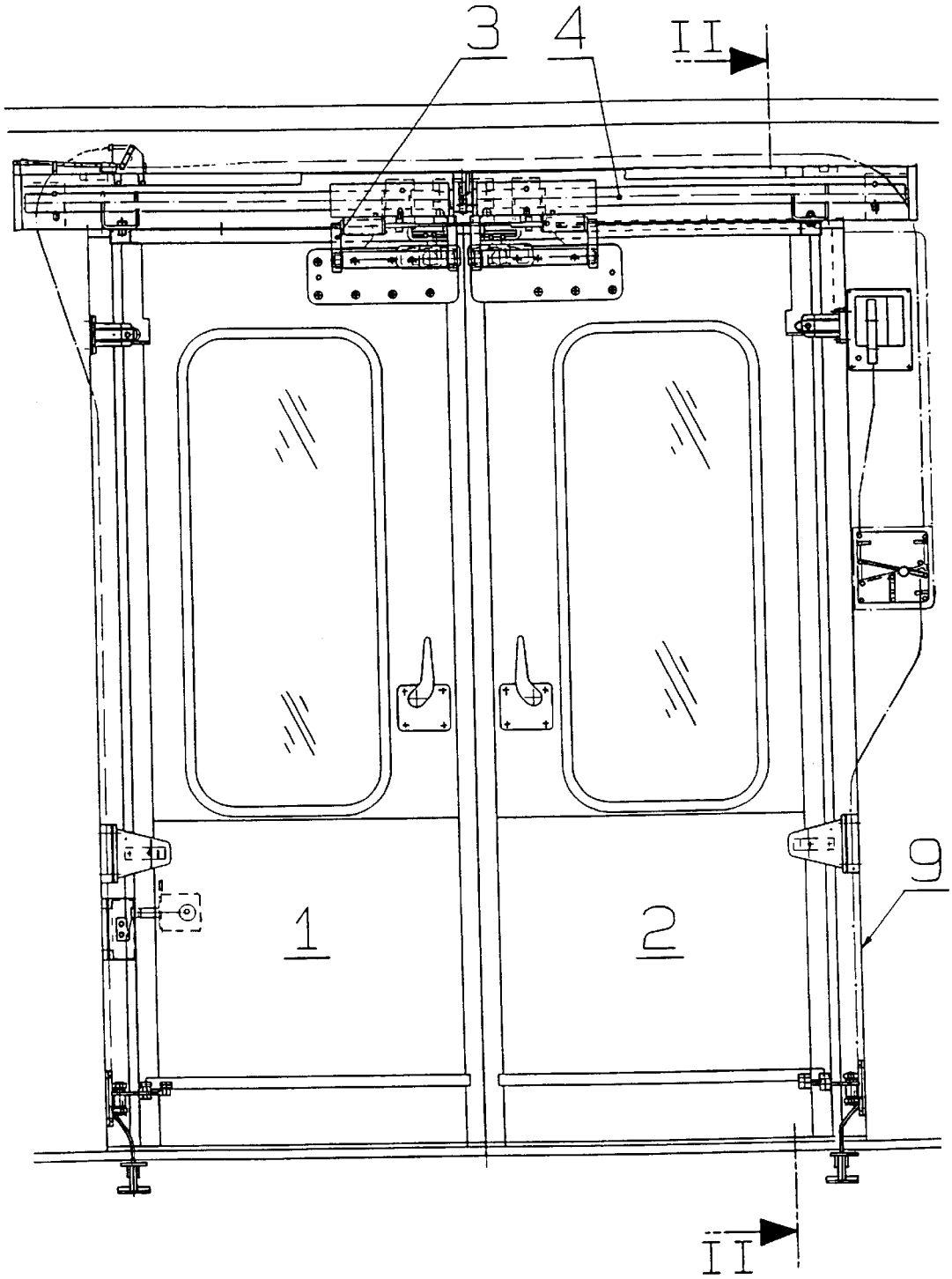
FIG. 1 shows an interior view of a door according to the invention without its covering.

The door according to the invention which is shown in FIG. 1 has two doors leaves 1, 2, each of which is fastened at a rail 4 so as to be swivelable by means of a slide 3. The drive itself, including the spindle, is not shown in this drawing.

Figure 2:
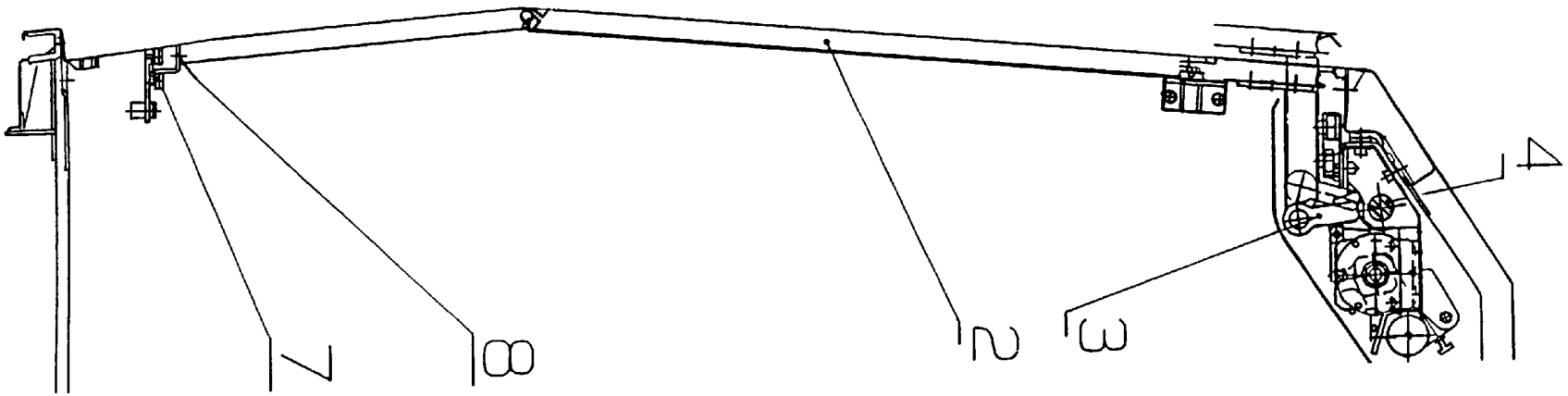
FIG. 2 shows a section along line II—II of FIG. 1.

FIG. 2 shows a view of the door along section II—II of FIG. 1. The rail 4, around which the slide 3 is supported in a swivelable manner, can be seen in section in the upper region of the door. The door 2 is shown in the closed position flush with the vehicle body and also in the opened out position as indicated by the thin section shown in the upper region.

The door itself is guided in the upper region by guide rollers 5 which run in a rail 6 and in the lower region by deflectable rollers 7 and associated guide rails 8 in the door.

The entire region of the lateral closing edges 9 located between the guide rollers and rails is free of built-in elements which could pose a risk of pinching.

Figure 3:
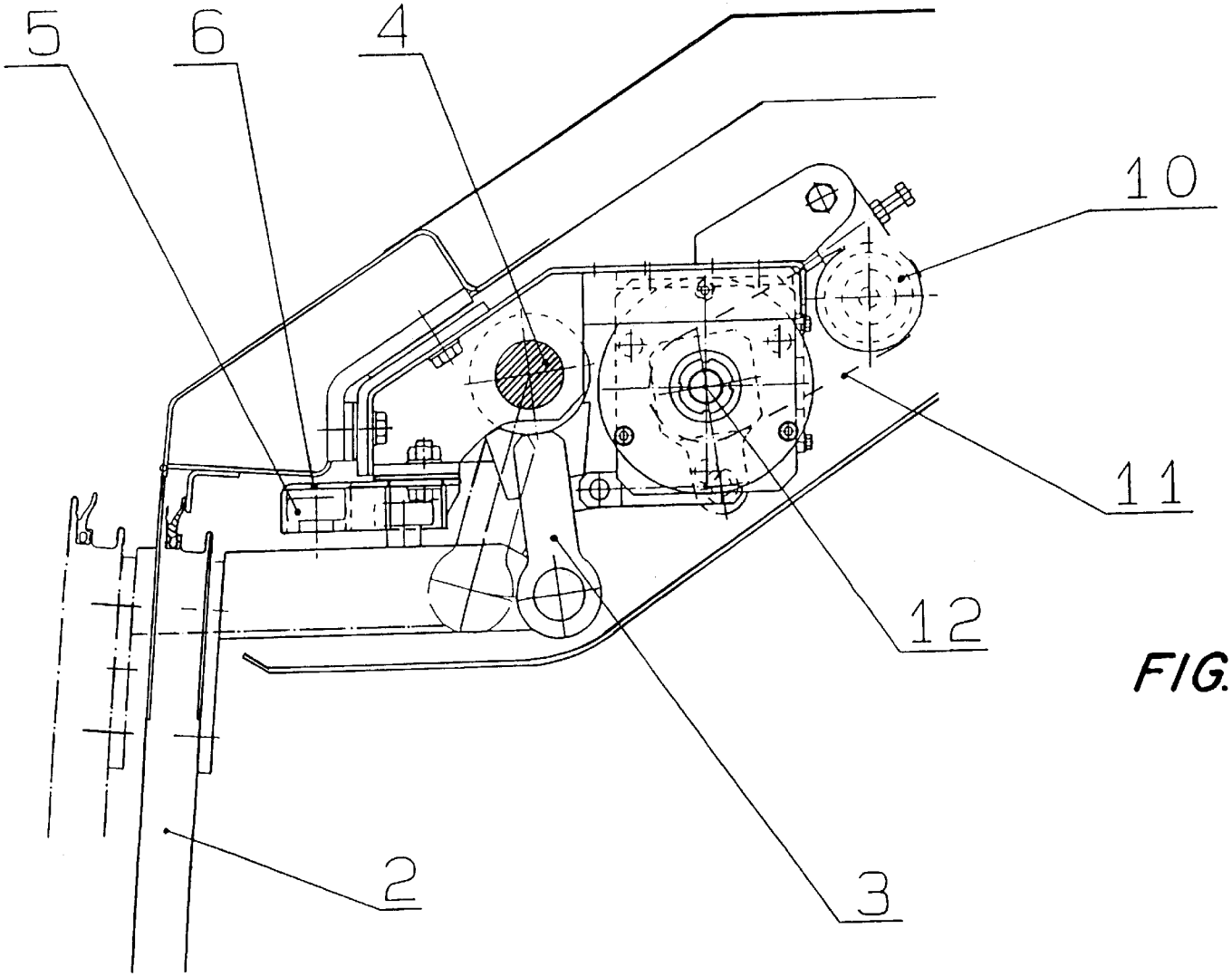
FIG. 3 shows an enlarged plan view of the upper part of FIG. 2.

FIG. 3 shows an enlarged plan view of the drive region according to FIG. 2. The drawing shows the actual drive motor 10 which sets a spindle in rotation via a toothed belt or V-belt 11. A nut 21 is connected in a stationary manner with each door 1, 2 and slide 3 associated therewith, this nut 21 being moved axially by the rotation of the spindle 12 resulting in an opening and closing of the door. The synchronizing of the two doors is brought about by a symmetrical construction of the spindle threads with respect to the plane of symmetry of the door.

Figure 4:
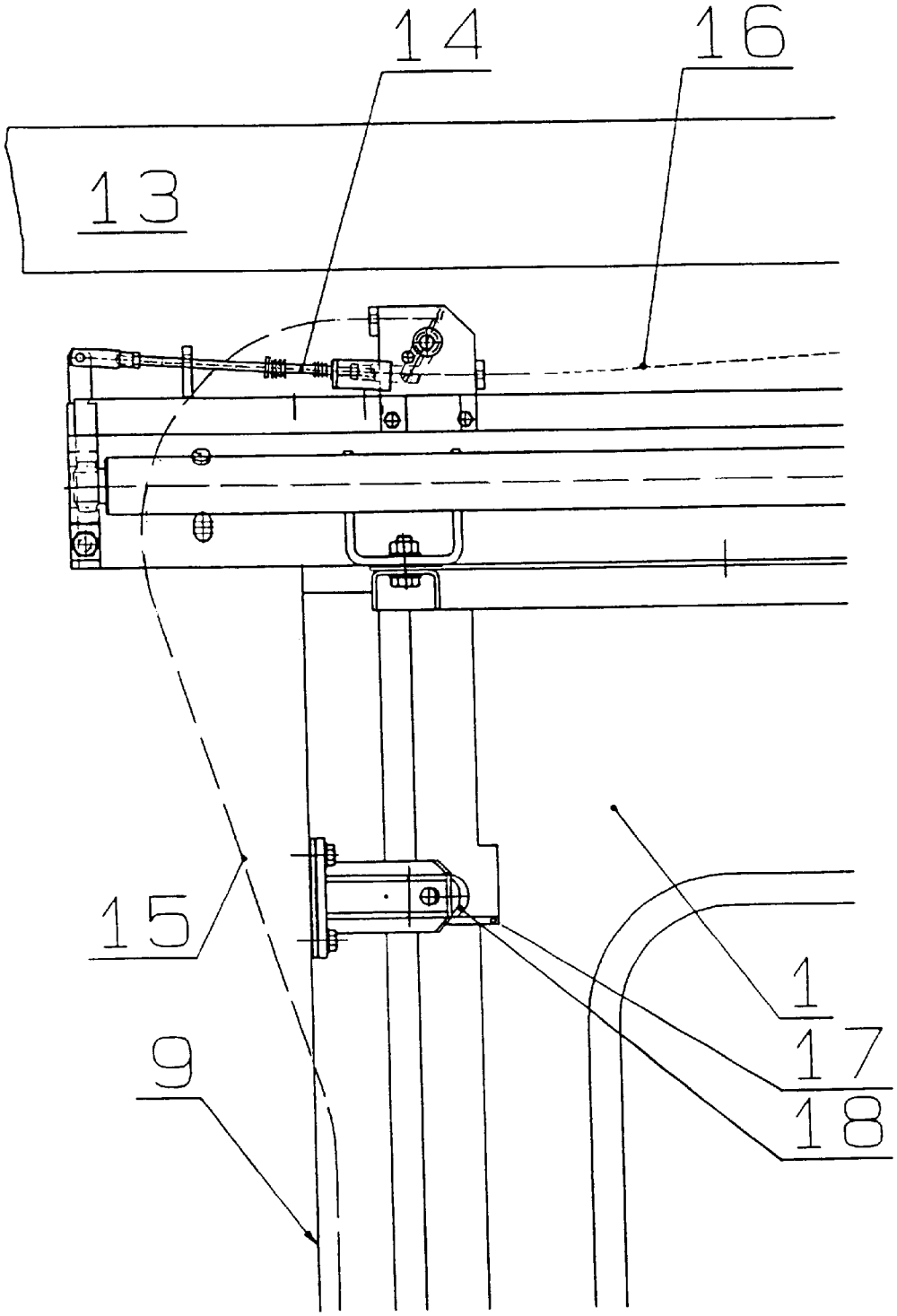
FIG. 4 shows the end remote of the drive of the spindle.

FIG. 4 shows the end of the spindle 12 remote from the drive 10 in a plan view corresponding to FIG. 1 wherein the rail 4 is located under, this spindle 12. An emergency actuating device 13, which can be released by the clutch or brake of the freewheel, only schematically is shown in FIG. 4.

In order to release the brake for emergency actuation and accordingly enable manual opening, an actuating rod 14 must be displaced to the right, with reference to the drawing, against the force of a spring 29, which is effected manually by means of a Bowden cable 15 or, in normal operation, by releasing the electromagnetic clutch.

Figure 7:
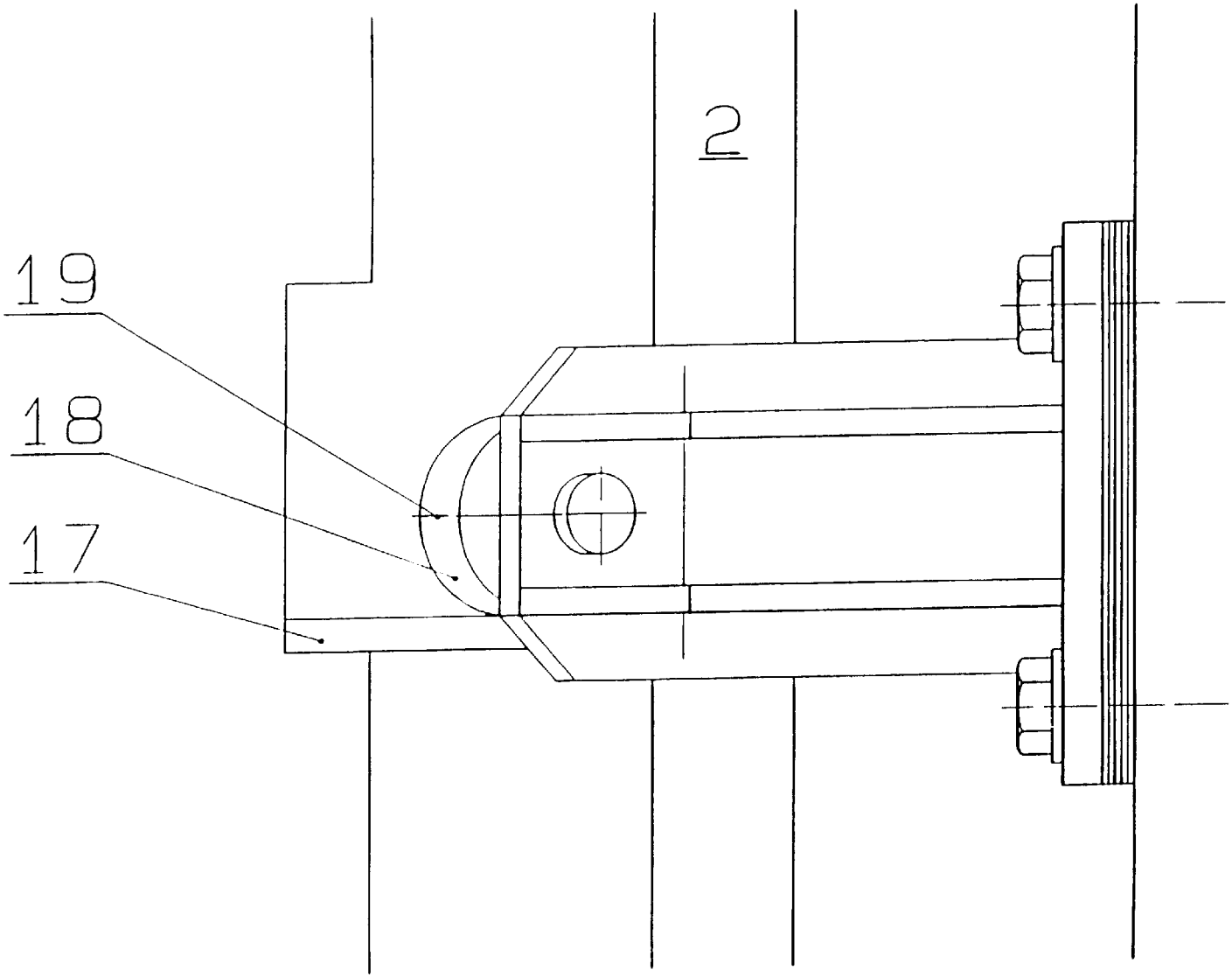
FIG. 7 shows an interior plan view of the support.

The support arranged in the upper door region for stabilizing the position of the door in the closed state is also shown in FIG. 4 and in enlarged scale in FIG. 7 with reference to door 2. A substantially horizontal running surface 17 is arranged at the door 1 at the lateral closing edge. In the closed state of the door, this running surface 17 cooperates with a roller 18 which comes to rest above the stop surface 17 and is supported thereon.

Figure 6:
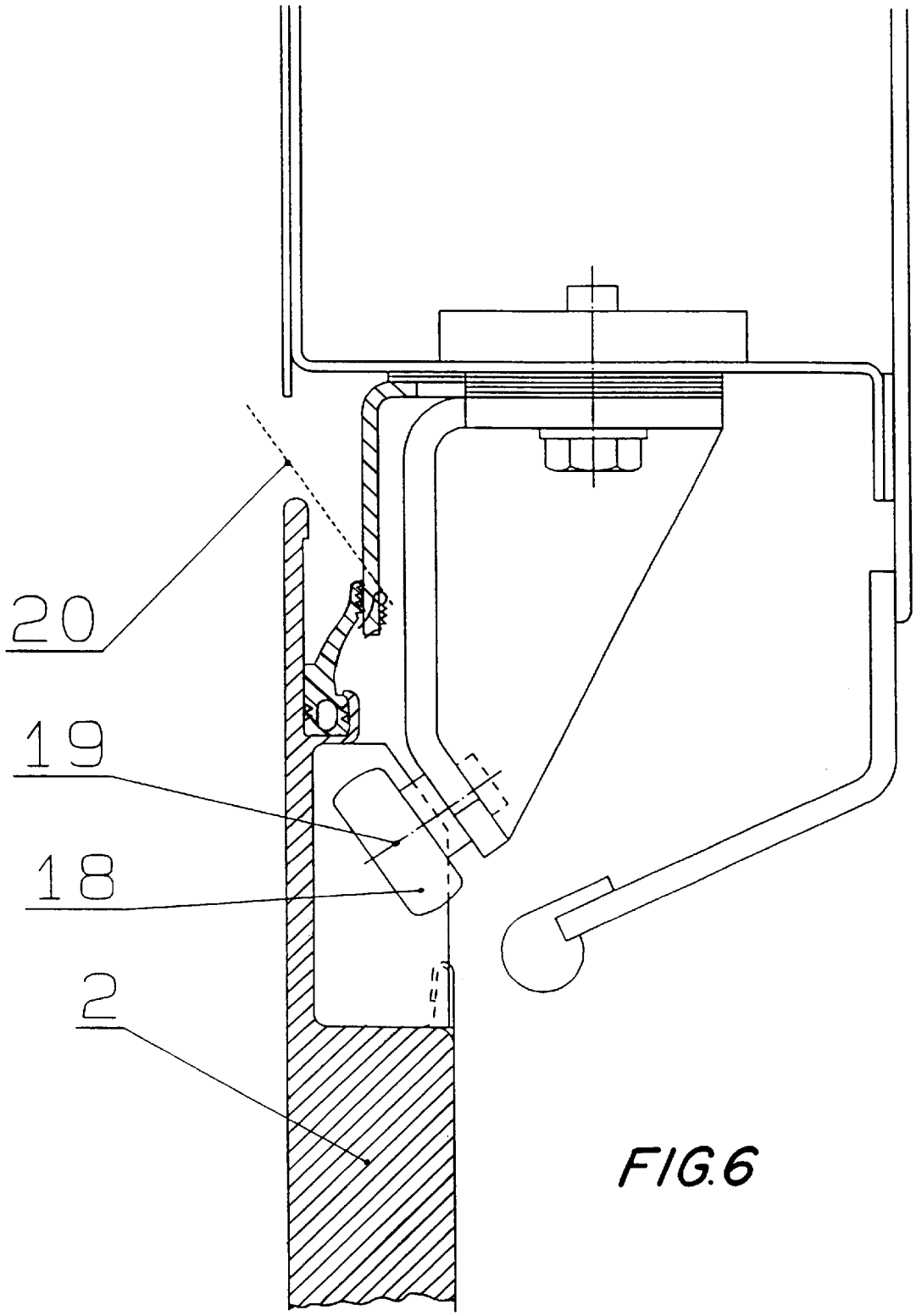
FIG. 6 is an enlarged top view showing the support.

The roller 18 is rotatable about a substantially horizontal axis 19 whose position is shown more clearly particularly in FIG. 6, although FIG. 6 refers to door 2. Towards the end of the closing process, the door moves substantially in the direction of line 20. The axis 19 of the roller 18 extends normal to the final closing direction 20.

With reference to FIG. 4 again, it will be seen clearly that the door is constructed in a freely supported manner in the region of the lateral closing edge. For this reason, any attempt to open it causes torque to be produced about an axis extending approximately horizontally and normal to the plane of the door resulting in a turning of the door approximately about its suspension at the slide 3. This turning causes the door to be lifted in the region of the lateral closing edge 9. This lifting is effectively prevented by the support 17, 18, whose vertical position has no influence on its action. This means that it is possible to arrange the support at a height where there is no danger of a passenger being pinched or risk of substantial soiling during operation. This height region is preferably located near the upper edge of the door so that the support is also covered by the covering of the door drive.

Figure 5:
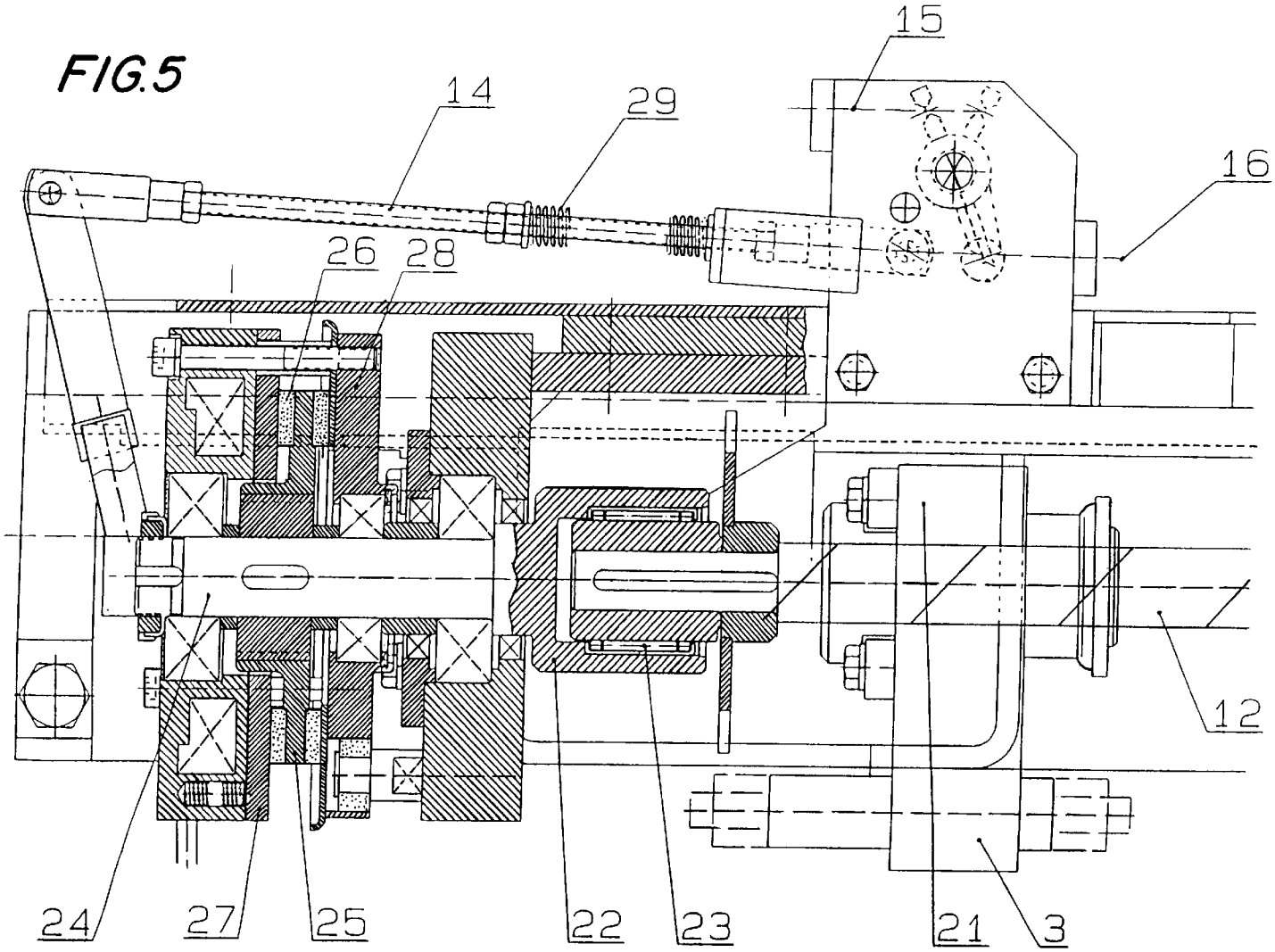
FIG. 5 shows this end in detail.

FIG. 5 shows an embodiment example of a freewheel, including brake, which can be used according to the invention. The plan view shows the end of the spindle 12 remote of the drive 10, including the nut 21 connected with the door via the slide 3, in the open position of the door.

The end of the spindle 12 is supported so as to be tiltable in a receptacle 22 also having a conventional freewheel 23. When the receptacle 22 is held so as to be fixed with respect to relative rotation, the freewheel 23 enables a rotating movement of the spindle 12 in the direction corresponding to the closing of the doors 1, 2.

In order to open the doors, i.e., to rotate the spindle in the opposite direction, it is necessary to release the receptacle 22 so that it can rotate along with the spindle 12. This is effected in the following manner: the receptacle 22 is connected in a stationary manner or integral with a shaft 24 which is supported so as to be rotatable relative to the body of the vehicle and is connected with a clutch disk 25 having clutch linings 26 at either end side.

Counter-disks 27, 28 are constructed on both sides of the clutch disk 25 considered axially. These counter-disks 27, 28 are fixed with respect to rotation relative to the vehicle body and are displaceable axially relative to the shaft 24. When the rod 14 is displaced toward the right, as indicated by its two positions, the two clutch disks 27, 28 are released axially by swiveling a cam so that the disk 25 which is located between the two clutch disks 27, 28 and connected with the shaft 24 is likewise released. This allows the receptacle 22 to rotate along with the spindle 12 in the opening direction.

This releasing is effected automatically by the door drive every time the door is opened or manually in case of emergency by means of the Bowden cable 15. Depending upon the user's attitude regarding safety precautions, the brake can either be applied again following manual actuation or can be held in the open position by means of a lever mechanism which is not shown in the drawing. In one case, proper closing and continued operation of the doors is enabled. In the other case, it is possible to determine misuse and to take countermeasures.

The special arrangement of the freewheel and brake results in a final closing position region in which the door is secured against unwanted opening instead of the fixed final closing position determined by the dead center point. This results in a substantial simplification in assembly because, for example, there is no longer any need to allow for rubber seals of varying width.

Figure 8:
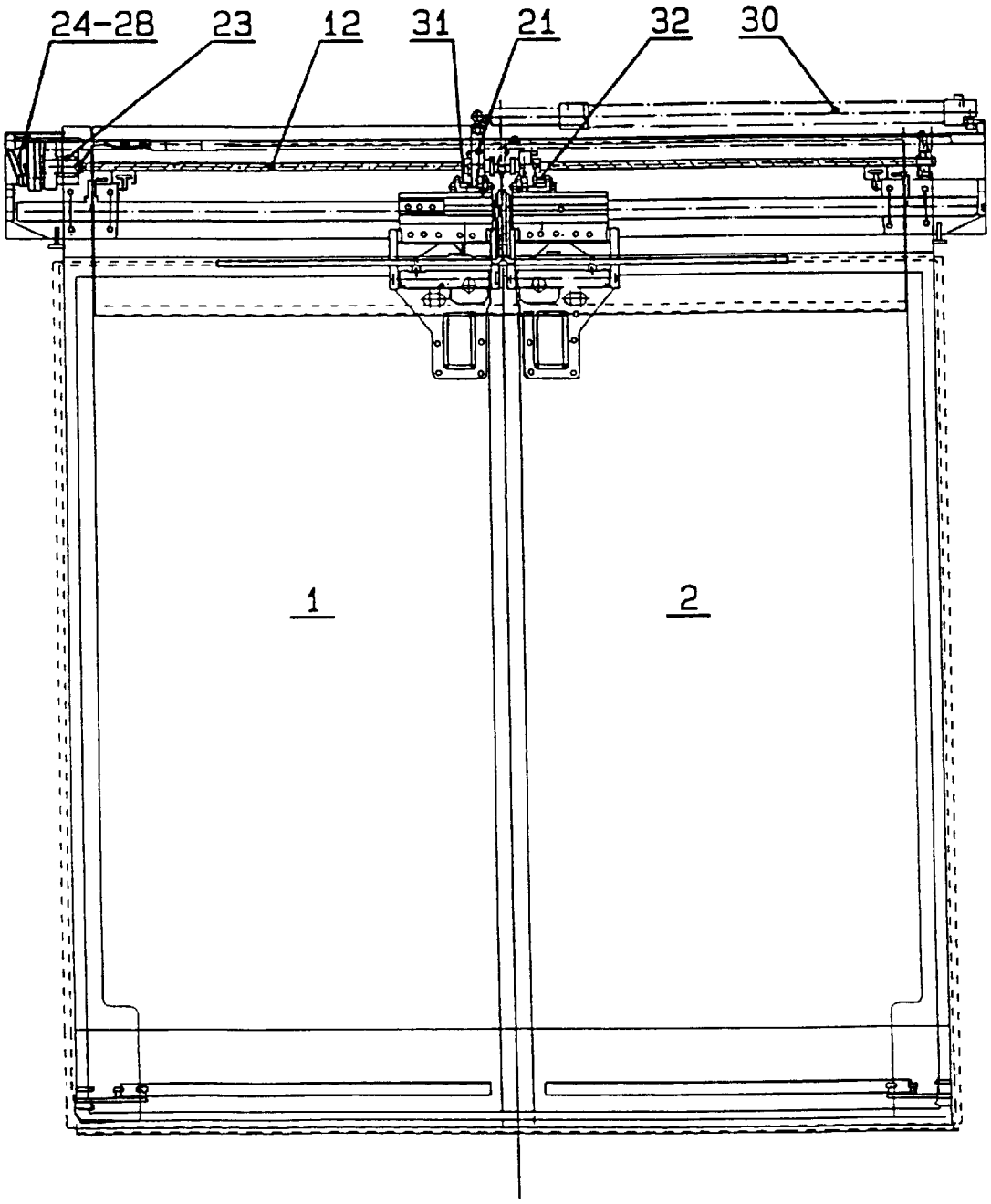
FIG. 8 shows another variant of a door according to the invention.

The embodiment form according to FIG. 8 shows a variant in a plan view similar to FIG. 1, although in this instance the actual door drive acts pneumatically, via a cylinder-piston unit 30, on a shoulder 31 which is connected in a stationary manner with the door leaf 1. In the example shown in the drawing, this is the nut 21 arranged on the spindle 12.

When the door leaf 1 is moved, this nut sets the spindle 12 in rotation so that the nut 32 connected with the door leaf 2 causes the door leaf 2 to move synchronously in a mirror-inverted manner with respect to door leaf 1.

The left end of the spindle 12, with reference to FIG. 8, carries a freewheel 23 and a brake or clutch 24–28 as is shown in detail in FIG. 5.

The door according to the invention is not limited to the example shown. For instance, it is possible to construct the drive of the spindle in a different manner, e.g., by means of a toothed wheel gear unit or, space permitting, by means of a motor flanged coaxially to the spindle.

If the issue is one only of unauthorized opening by the user, the support 17, 18 can be constructed differently, e.g., by means of two supporting surfaces which are a slight distance apart in the normal state and can be suitably lubricated under certain circumstances in order to reduce wear.

However, it is also possible to provide two supporting surfaces 17 at the door, one of which lies below the support roller, as is shown, while the other comes to rest above the support roller, so that the slide 3 and the supporting rail 4 are relieved of loading in the closed state of the door. Of course, it is also possible to provide the roller at the door and to provide the supporting surface(s) at the body of the vehicle.

Another construction of the invention with respect to the releasable freewheel consists in arranging the latter coaxially to the spindle 12. Should there be insufficient space adjacent to the door opening for the indicated embodiment form, it will be an easy task for the person skilled in the art to arrange the freewheel, including the releasable brake, at an incline at the top within the spindle 12 as seen from the body side similar to the door drive 10 shown in the drawing and to produce a working connection by means of a V-belt or toothed belt, toothed wheel gear unit, chain or the like. Apart from reducing overall length, this also has the advantage that the spindle 12 can be supported in a stationary manner at both sides and that the brake can also be taken into account per se during assembly since the working connection is capable of compensating for assembly errors and oblique axial positions and the like.

The brake can be constructed so as to produce a frictional engagement (friction clutch) or a positive engagement (toothed clutch).

If a linear drive is used, it may be constructed pneumatically as was already mentioned, but can, of course, also be constructed hydraulically or electrically. It can act on one of the door leaves or on the spindle via an independent nut.

In doors which slide exclusively without an opening out movement, e.g., pocket doors which are pushed into a pocket between the outer wall and inner wall of the vehicle when opened, a linear drive can be arranged in a particularly simple manner since it need not participate in a swinging movement.

The spindle itself can have various profiles, e.g., the conventional trapezoidal profile. However, spline spindles are particularly preferred.

Any device permitting rotation of the spindle 12 in the direction corresponding to the closing direction of the door even when the stationary part of the freewheel is fixed, but which prevents a rotation in the opposite direction, can be used as freewheel. When the stationary part is fixed against rotation, the spindle can rotate in any direction.

What is claimed is:

1. A sliding door arrangement comprising at least one door leaf mounted in a door frame, a nut attached to the at least one door leaf, a spindle having first and second ends, the spindle extending through and meshing with the nut, a drive for moving the at least one door leaf, the drive being configured to one of rotate the spindle so that the nut linearly moves the at least one door leaf and directly linearly move the at least one door leaf, further comprising a freewheel mounted on the first end of the spindle so as to enable the spindle to rotate when the at least one door leaf is moving in a closing direction thereof, the freewheel having a component which is stationary relative to but capable of rotating together with the spindle, and a releasable device selected from the group comprising a brake and a clutch configured to prevent rotation of the component of the freewheel.

2. The sliding door arrangement according to claim 1, wherein the drive is one of an electric drive, a pneumatic drive and a hydraulic drive.

3. The sliding door arrangement according to claim 1, comprising two door leafs mounted symmetrically relative a center, a nut being attached to each of the door leafs, the spindle being mounted symmetrically relative to the center and extending through and meshing with the nuts.

4. The sliding door arrangement according to claim 3, wherein the drive for rotating the spindle is mounted at the second end of the spindle.

5. The sliding door arrangement according to claim 3, wherein the drive for linearly moving the door leafs is mounted above one of the two door leafs and is connected to another of the two door leafs.

6. The sliding door arrangement according to claim 5, wherein the drive for linearly moving the door leafs is a pneumatic piston-cylinder unit.

7. The sliding door arrangement according to claim 1, comprising electrical means for releasing the brake or clutch.

8. The sliding door arrangement according to claim 1, wherein the drive is a pneumatic drive, further comprising pneumatic means for releasing the brake or clutch.

9. The sliding door arrangement according to claim 1, wherein the drive is a hydraulic drive, further comprising hydraulic means for releasing the brake or clutch.

10. The sliding door arrangement according to claim 1, wherein the at least one door leaf has an upper edge and a lateral closing edge, the at least one door leaf having a running surface and the door frame having a counter-support surface, wherein, in a closed position of the at least one door leaf, the running surface is located essentially immediately below the counter-support surface.

11. The sliding door arrangement according to claim 10, wherein the running surface is located near the upper edge of the door.

12. The sliding door arrangement according to claim 10, wherein the counter-support surface is a roller, the roller being swivelable about a substantially horizontal axis, wherein the substantially horizontal axis extends substantially normal to a final closing direction of the door leaf.

13. The sliding door arrangement according to claim 10, comprising an additional running surface provided in the door leaf and located substantially directly above the counter-support surface.

* * * * *